US010502014B2

(12) United States Patent
Kletzel

(10) Patent No.: US 10,502,014 B2
(45) Date of Patent: Dec. 10, 2019

(54) EXTENDED REACH TOOL

(71) Applicant: Coil Solutions, Inc., Alice, TX (US)

(72) Inventor: Robert Kletzel, Medicine Hat (CA)

(73) Assignee: Coil Solutions, Inc., Alice, TX (US)

( * ) Notice: Subject to any disclaimer, the term of this patent is extended or adjusted under 35 U.S.C. 154(b) by 0 days.

(21) Appl. No.: 15/970,691

(22) Filed: May 3, 2018

(65) Prior Publication Data

US 2018/0320468 A1 Nov. 8, 2018

Related U.S. Application Data

(60) Provisional application No. 62/500,870, filed on May 3, 2017.

(51) Int. Cl.
*E21B 31/00* (2006.01)
*E21B 28/00* (2006.01)

(52) U.S. Cl.
CPC ..... *E21B 31/005* (2013.01); *E21B 28/00* (2013.01)

(58) Field of Classification Search
CPC ..... E21B 7/18; E21B 17/18; E21B 17/203; E21B 21/12; E21B 37/00; E21B 41/0078; E21B 43/29
See application file for complete search history.

(56) References Cited

U.S. PATENT DOCUMENTS 137,881 A 4/1873 Berryman et al.
4,012,061 A * 3/1977 Olson ..... E21B 17/042 285/114
4,067,596 A * 1/1978 Kellner ..... E21B 17/042 175/215
4,633,958 A 1/1987 Mouton
4,667,750 A * 5/1987 Wise ..... E21B 7/18 175/213
4,819,745 A * 4/1989 Walter ..... E21B 7/18 175/107

(Continued)

FOREIGN PATENT DOCUMENTS

AU 2016202533 A1 11/2016
AU 2016202619 A1 11/2016

(Continued)

OTHER PUBLICATIONS

Notice of Allowance dated Dec. 1, 2017, in U.S. Appl. No. 14/967,757.

(Continued)

*Primary Examiner* — Jennifer H Gay
(74) *Attorney, Agent, or Firm* — Ramey and Schwaller LLP; William P. Ramey; Craig Buschmann

(57) ABSTRACT

An extended reach tool includes two or more separate flow paths, wherein each of the flow paths has multiple hollow chambers connected in series. Each of the hollow chambers includes a first constricted chamber with a fluid entry, a first expansion chamber located adjacent to the lower end of the first constricted chamber, and a second constricted chamber with the upper end of connected to the lower end of the first expansion chamber. A separate second expansion chamber is connected to the lower end of a plurality of the second constricted chambers. A single port is located adjacent to the lower end of the second expansion chamber.

3 Claims, 2 Drawing Sheets

(56) References Cited

U.S. PATENT DOCUMENTS 4,852,668 A * 8/1989 Dickinson, III ..... E21B 7/065 175/67
4,852,800 A * 8/1989 Murdock ..... B05B 1/10 239/1
5,154,347 A * 10/1992 Vijay ..... B05B 1/08 239/102.2
5,228,508 A * 7/1993 Facteau ..... E21B 28/00 166/177.2
5,230,389 A * 7/1993 Besson ..... E21B 7/18 137/813
5,495,903 A 3/1996 Griffin
5,732,885 A * 3/1998 Huffman ..... B05B 7/0475 239/416.5
5,897,062 A 4/1999 Enomoto et al.
6,029,746 A 2/2000 Dodd
6,039,117 A 3/2000 Mueller
6,062,311 A 5/2000 Johnson et al.
6,397,864 B1 6/2002 Johnson
6,470,980 B1 * 10/2002 Dodd ..... B08B 9/0433 175/340
6,976,507 B1 12/2005 Webb et al.
7,404,416 B2 7/2008 Schultz et al.
7,650,941 B2 1/2010 Zachry
7,836,934 B2 11/2010 Kusko et al.
7,913,763 B2 3/2011 D'Amico
8,230,912 B1 7/2012 Connell
8,316,944 B2 11/2012 Pringle et al.
8,424,620 B2 4/2013 Perry et al.
8,453,945 B2 * 6/2013 Wurz ..... B05B 7/0458 239/106
8,528,423 B1 9/2013 Schultz et al.
8,549,932 B1 10/2013 Schultz et al.
8,783,338 B1 * 7/2014 Ferguson ..... E21B 43/114 166/169
8,936,094 B2 1/2015 Least et al.
9,447,663 B1 9/2016 Connell et al.
9,932,798 B1 * 4/2018 Resendez ..... E21B 37/00
2001/0054515 A1 12/2001 Eddison et al.
2004/0013446 A1 2/2004 Dodd
2005/0051335 A1 * 3/2005 Davis ..... B08B 9/0433 166/312
2005/0214147 A1 9/2005 Schultz et al.
2006/0027372 A1 * 2/2006 Shaposhnikov .... E21B 41/0078 166/316
2006/0086507 A1 * 4/2006 Surjaatmadja ..... E21B 37/00 166/312
2010/0270081 A1 10/2010 Perry et al.
2011/0315403 A1 12/2011 Nard et al.
2012/0061073 A1 3/2012 Soni et al.
2012/0168013 A1 7/2012 Schultz et al.
2012/0292015 A1 11/2012 Schultz et al.
2013/0199849 A1 8/2013 Li
2013/0213716 A1 8/2013 Perry et al.
2014/0009305 A1 1/2014 Schultz et al.
2014/0034312 A1 2/2014 Schultz et al.
2014/0048333 A1 2/2014 Fears et al.
2014/0196548 A1 7/2014 Watson et al.
2014/0202699 A1 7/2014 Loving
2015/0275641 A1 10/2015 Watson et al.
2015/0337193 A1 11/2015 Britton et al.
2015/0354303 A1 12/2015 Schultz et al.
2016/0024875 A1 1/2016 Watson et al.
2016/0024885 A1 1/2016 Schultz et al.
2016/0040493 A1 1/2016 Schultz et al.
2016/0031066 A1 2/2016 Watson et al.
2016/0069173 A1 3/2016 Castro et al.
2016/0115767 A1 4/2016 Watson
2016/0177668 A1 6/2016 Watson et al.
2016/0230502 A1 8/2016 Holmberg et al.
2016/0236331 A1 8/2016 Watson
2016/0319630 A1 11/2016 Watson et al.
2016/0319631 A1 11/2016 Schultz et al.
2016/0319632 A1 11/2016 Schultz et al.
2016/0319647 A1 11/2016 Schultz et al.
2016/0326832 A1 11/2016 Watson et al.
2016/0326834 A1 11/2016 Manke et al.
2016/0340994 A1 11/2016 Ferguson et al.
2012/6376868 12/2016 Manke
2016/0348465 A1 12/2016 Schultz et al.
2016/0348466 A1 12/2016 Schultz et al.
2016/0348467 A1 12/2016 Watson et al.
2017/0030169 A1 2/2017 Funkhouser et al.
2018/0320451 A1 * 11/2018 Kletzel ..... E21B 12/00
2018/0320468 A1 * 11/2018 Kletzel ..... E21B 31/005

FOREIGN PATENT DOCUMENTS

AU 2016202624 A1 11/2016
CA 2875509 A 12/2013
CA 2875540 A 12/2013
CA 2922474 A1 3/2015
CA 2926646 A1 4/2015
CA 2933187 A1 6/2015
CA 2945290 A1 10/2015
CA 2945815 A1 10/2015
CA 2948853 A1 11/2015
CA 2951397 A1 12/2015
CA 2954884 A1 1/2016
CN 103547768 A 1/2014
CN 105917072 A 8/2016
MX 2013013453 A 2/2014
MX 2014007923 A 7/2014
MX 2014009242 A 10/2014
MX 2014012982 A 2/2015
MX 2015001993 A 5/2015
MX 2015002689 A 5/2015
MX 2015002253 A 8/2015
MX 2015009948 A 1/2016
MX 2016002960 A 6/2016
WO 2004013446 A2 2/2004
WO 20111136830 A1 11/2011
WO 2012018700 A2 2/2012
WO 2012018700 A3 4/2012
WO 2012082514 A2 6/2012
WO 2012158575 A2 11/2012
WO 2013116094 A2 8/2013
WO 2012158575 A3 10/2013
WO 2013162956 A9 10/2013
WO 2014028254 A2 2/2014
WO 2014035901 A3 3/2014
WO 2013116094 A3 4/2014
WO 2013162956 A3 8/2014
WO 2014028254 A3 8/2014
WO 2014035901 A3 8/2014
WO 2015077716 A1 5/2015
WO 2014160716 A3 6/2015
WO 2015120181 A1 8/2015
WO 2016025025 A1 2/2016
WO 2016068882 A1 5/2016
WO 2016134151 A1 8/2016
WO 2016175876 A1 11/2016
WO 2016176181 A1 11/2016
WO 2017014820 A1 1/2017
WO 2017025838 A1 2/2017

OTHER PUBLICATIONS

Milling and Cleanout Services; Thru Tubing Solutions; Thru Tubing Solutions—Product Categories; http://www. thrutubing.com/ProductCategory.aspx?Category=2&name=Milling%20and%20Cleanout%20Services; Obtained Feb. 23, 2017.

Wash Nozzle; Thru Tubing Solutions; Thru Tubing Solutions—Product Details; http://www.thrutubing.com/ProductDetails.aspx?ProductId=46; Obtained Feb. 24, 2017.

International Search Report and Written Opinion dated Aug. 13, 2018, in International Application No. PCT/US18/30891.

Non-Final Office Action dated Jun. 22, 2018, in U.S. Appl. No. 15/970,644.

(56) References Cited

OTHER PUBLICATIONS

International Search Report and Written Opinion dated Aug. 31, 2018, in International Application No. PCT/US18/30903.

* cited by examiner

EXTENDED REACH TOOL

RELATED APPLICATIONS

This application claims priority to U.S. Provisional Patent Application 62/500,870 filed on May 3, 2017; which is specifically incorporated by reference in its entirety herein.

FIELD

The disclosure relates generally to apparatus and methods for creating a vibration within a wellbore. The disclosure relates specifically to a vibrating downhole tool configured to vibrate equipment located within a wellbore.

BACKGROUND

In the drilling of oil and gas wells as well as other downhole activities, it is common to use a downhole system which provides a percussive or hammer effect to the drill string to increase drilling rate. For example, in the process of drilling a wellbore, frictional forces acting against the drill pipe or other component running through the wellbore limit the maximum length or depth to which the wellbore may be drilled. Solutions of this problem include mechanisms for vibrating the drill pipe during drilling in order to convert static frictional forces on the drill pipe to dynamic frictional forces between the drill pipe and the wall of the wellbore.

Various types of vibrator devices have been employed with pipe strings in order to provide vibration. Some such vibrator devices typically employ reciprocating impact elements that move back and forth along the axis of the pipe string to induce vibration in the pipe string. Other such vibrator devices employ the use of eccentrically weighted rotating masses, eccentric shafts or rods, or rotatable impact elements that rotate about the longitudinal axis of the drill or pipe string to strike an impact anvil in order to apply a rotational or torsional vibration to the pipe string.

Still other types of vibrator devices utilize Moineau power sections that are generally used in downhole mud motors or pumps. Moineau power sections typically utilize rubber or rubber-like elastomers as seals which are negatively affected by elevated wellbore temperatures and pressures, certain drilling fluids and or chemicals, and contaminants or debris in the wellbore or drilling fluids.

Apparatus utilizing one or both of these principles is described in U.S. Pat. No. 5,165,438 to David M. Facteau. Two fluidic oscillators are achieved by employing wedge-shaped splitters to route the flow of a fluid down diverging diffuser legs. The oscillators connect to a source of fluid flow, provide a mechanism for oscillating the fluid flow between two different locations within the oscillator, and emit fluid pulses downstream of the source of the fluid flow. In one vibrator, a feedback passageway from each leg is routed back to the flow path upstream of the splitter to create a condition establishing oscillating flow through the legs. In a second vibrator, a passageway between the legs downstream of the upstream end of the splitter creates a condition establishing oscillating flow through the legs. A disadvantage of this kind of oscillator is that the diverging diffuser legs required to establish oscillation are expensive to fabricate and prone to clogging from debris in the fluid because of the relative incline between the leg and the axial of the pipe string.

Consequently, there is a need to provide an even more effective fluid oscillator for down hole tools which is reliable, long-lived and economical.

SUMMARY

The present invention is directed to a helix oscillating delivery system that creates an erratic helical pulsating stream within a circular cylindrical structure. The helix oscillating delivery system connects to a source of fluid flow at its upper end and has a plurality of separate flow paths that are constricted and expanded repeatedly. The erratic helical pulsating stream is caused by the flow paths and strengthened by an expansion chamber.

In one embodiment, the helix oscillating delivery system comprises two or more separate flow paths. Each of the flow paths has multiple hollow chambers connected in series. Each of the hollow chambers comprises a first constricted chamber 6 with a fluid entry, a first expansion chamber located adjacent to the lower end of the first constricted chamber, a second constricted chamber with an upper end connected to the lower end of the first expansion chamber; a separate second expansion chamber connected to the lower ends of a plurality of the second constricted chambers; and a single port located adjacent to the lower end of the second expansion chamber.

The cross-section area of the first constricted chamber is smaller than that of the first expansion chamber and the cross-section area of the first expansion chamber is larger than that of the second constricted chamber.

The cross-section area of the second expansion chamber gradually decreases from a top end to a bottom end of the second expansion chamber.

In a preferred embodiment, the shape of the cross-section of the second expansion chamber is circular, and the longitudinal section of the second expansion chamber is a trapezoidal section with a large top base and a small bottom base.

In another aspect, the invention is directed to an extended reach tool. The tool comprises two or more separate flow paths. Each of the flow paths has multiple hollow chambers connected in series. Each of the hollow chambers comprises a first constricted chamber with a fluid entry, a first expansion chamber located adjacent to the lower end of the first constricted chamber, a second constricted chamber with the upper end connected to the lower end of the first expansion chamber; a separate second expansion chamber connected to the lower ends of a plurality of the second constricted chambers; and a single port located adjacent to the lower end of the second expansion chamber.

In one embodiment, the extended reach tool can be attached to a tubing or motor on a top side of the extended reach tool and attached to a bottom hole assembly on a bottom end of the extended reach tool.

In one embodiment, the extended reach tool comprises a thread pin adapted to engage a threaded box of a tubing or motor, and a threaded box end to receive male threaded pin end of a bottom hole assembly.

In another aspect, the invention is direct to a method of delivering an erratic helical pulsating jet stream within an extended reach tool connected to a drill string pipe/coil tubing or a bottom hole assembly. The tool receives fluid from the drill string pipe or coil tubing into a hollow interior of the tool, wherein the fluid is separated into two or more separate flow paths. The fluid is repeatedly compressed and expanded, which will create a pulsating flow with erratic helical flow, and the pulsating flow passes out of the tool through ports in the tool to create pulsing and erratic helical jets of fluid. The erratic, helically pulsating jets of fluid will cause the extended reach tool to vibrate and pulsate a bottom hole assembly and coil tubing/tubing to release friction around them so as to move the bottom hole assembly freely downhole and up hole.

In one embodiment, the fluid is separated into two separate paths.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

Figure 1A:
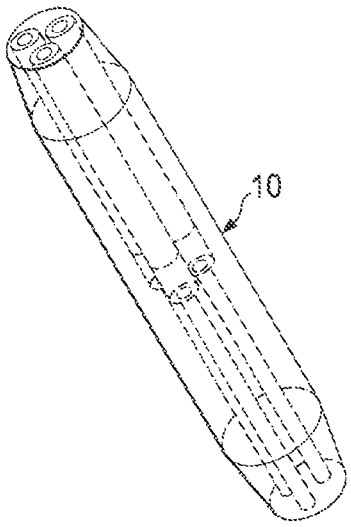
FIG. 1*a* is a transparent perspective view of an extended reach tool in accord with one possible embodiment of the present invention.
Figure 1B:
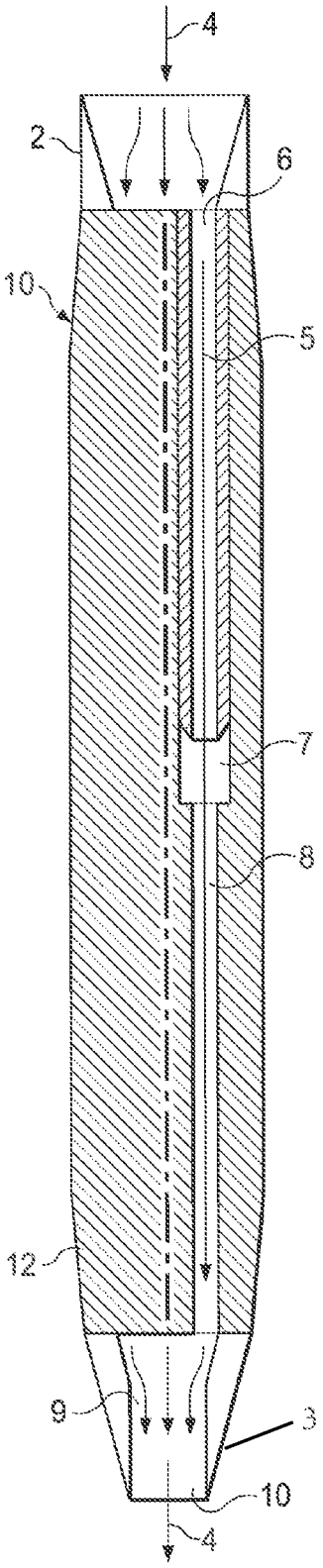
FIG. 1*b* is a cross-sectional view of the extended reach tool in FIG. 1*a* in accord with one possible embodiment of the present invention.

The present invention pertains to a helix oscillating delivery system that creates a pulsating flow within a circular cylindrical structure. The helix oscillating delivery system connects to a source of fluid flow at its upper end and has a plurality of separate flow paths that are constricted and expanded repeatedly. The flow paths enter into an expanded area and the expanded area connects to a single port on its lower end. Referring to FIG. 1, the helix oscillating delivery system comprises two or more separate flow paths 5, each of the flow paths 5 has multiple hollow chambers connected in series. For example, a flow path has a first constricted chamber 6 with a fluid entry, a first expansion chamber 7 is located adjacent to a lower end of the first constricted chamber 6. An upper end of the second constricted chamber 8 is connected to a lower end of the first expansion chamber 7. There is a separate second expansion chamber 9 connected to the lower ends of a plurality of the second constricted chambers 8 of the flow paths 5. Then a single port 10 is located adjacent to a lower end of the second expansion chamber 9. The chambers 6, 7, and 8 are columnar hollow structures and the shapes of the cross-section of the chambers are arbitrary. In some embodiments, the cross-sectional shapes can be rectangular, squares, triangular, rhomboid, and ellipse. In a preferred embodiment, the shapes of the cross-section of the chambers are circular in order to reduce the effects of resistance and drag applied to the fluid flow in the chambers.

Figure 2:
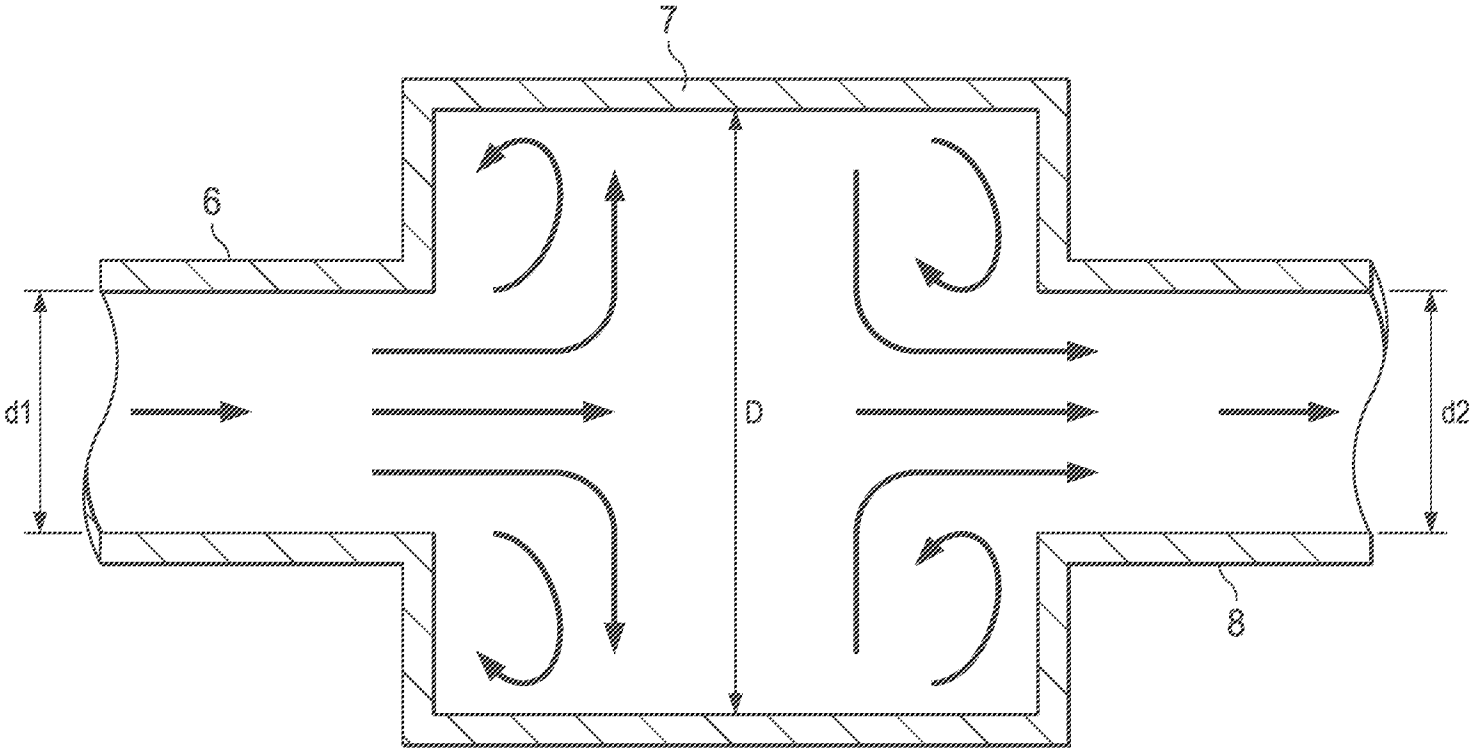
FIG. 2 is a view to show the fluid flowing in chambers of a flow path in a helix oscillating delivery system.

The cross-section area of the first constricted chamber 6 is smaller than that of the first expansion chamber 7 and the cross-section area of the first expansion chamber 7 is larger than that of the second constricted chamber 8. FIG. 2 illustrate fluid flowing in chambers 6, 7 and 8 which are connected in series. The arrows indicate the direction of the movement of the fluid. In FIG. 2, chamber 6, 7 and 8 are of cylinder shapes and have inner diameters d1, D and d2 respectively, where $d1<D$ and $D>d2$. The fluid is compressed in chamber 6 because of the restriction in flow and decrease in diameter, and the velocity of the fluid will increase. When the fluid enters into chamber 7, it will expand and the velocity of the fluid will decrease because of the increase in diameter of the chamber 7. Then when the fluid enters into chamber 8 from chamber 7, the fluid will be compressed and the velocity of it will increase, which will create a pulsing flow. The fluid near the section between chamber 6 and chamber 7 will be subject to high shear forces because of the density and viscosity of the fluid and the sudden expansion of the fluid. The shear forces cause vortex turbulence in the chamber 7. Similarly, shear forces near the section between chamber 7 and chamber 8 cause vortex turbulence in the chamber 7 because of the sudden contraction of the fluid. The vortex turbulence is propagated in the chamber 7, which induces an erratic helical flow. The erratic helical flow amplifies the pulsation of the pulsing flow.

In some embodiments, the shape of the cross-section of the expanded chamber 9 can be rectangles, squares, triangles, rhomboid, ellipse. The cross-section area of the expanded chamber 9 gradually decreases from a top end to a bottom end of it. In a preferred embodiment the shape of the cross-section of the expanded chamber 9 is circular, the longitudinal section of the expanded chamber 9 is a trapezoidal section with a large top base and a small bottom base. With this construction, the pulsing flows from a plurality of chambers 8 will expand and generate vortex turbulence which will interfuse with each other, such that the erratic helical flows from a plurality of chambers 8 will interfere with each other to generate stronger erratic helical flow. And at the same time, the fluid will be concentrated because of the gradually decreased cross-section area of the expanded chamber 9. The erratic helical flow further amplifies the pulsation of the pulsing flow in the expanded chamber 9. Then the pulsing flow is deflected and forced into the single port 10. The single port 10 can be a hollow cylinder or a conical structure with an up-narrow and down-wide configuration to form a flow path for the erratic helical pulsating stream.

As a result, a strong pulsating stream with erratic helical flow is developed in the helix oscillating delivery system without any external excitation, and no moving parts or valve arrangements are required to bring about a pulse flow.

The helix oscillating delivery system can be used in a downhole system to provide pulsation. In one embodiment, it can be used as an extended reach tool to prevent stick-slip incidences with coil tubing or lock-up of jointed pipe between cased hole/open hole, and with tubing or coil tubing while milling, drilling or performing service work.

The extended reach tool can be used to vibrate and pulsate coil tubing/tubing and milling, drilling, or service work bottom hole assemblies to eliminate friction of the coil tubing or tubing in cased hole or open hole, so as to allow the bottom hole assembly to reach the depth in the cased hole or open hole well to complete the desired milling, drilling or service job.

Referring back to FIG. 1, the extended reach tool 10 will be attached to a tubing or motor (not shown) on top side 2 and attached to a bottom hole assembly (not shown) on the bottom end 3. The extended reach tool 10 can be used on any size tubing. The top side 2 may have a male threaded box adapted to receive a female threaded pin of the tubing, and the bottom end 3 may comprise a female threaded pin end to engage a male threaded box end of the bottom hole assembly.

Fluid flow 4 enters from the top side 2 into the extended reach tool 10. The entry of the flow into the tool can be through an inclusive box or pin of said tool or a crossover that can be attached to the tool. The tool is provided internally with two or more separate flow paths 5, each of the flow paths 5 has multiple hollow chamber connected in series. A flow path 5 has a first constricted chamber 6 with a fluid entry, a first expansion chamber 7 is located adjacent to a lower end of the first constricted chamber 6. An upper end of the second constricted chamber 8 is connected to a lower end of the first expansion chamber 7. Fluid flow 4 is alternatingly constricted in chamber 6, then expanded in chamber 7 and then constricted in chamber 8 to cause itself to pulsate in a flow pattern with erratic helical flow. The flow paths are all arranged in a case 12. The flow 4 from the chamber 8 enters into the second expansion chamber 9 and is forced into the single port 10 which can be part of the tool or an add on, extending through the extended reach tool 10 on a lower end for delivering erratic helically pulsating jets of fluid out of the tool. The erratic helically pulsating jets of fluid will cause the extended reach tool 10 to vibrate and pulsate the bottom hole assembly and coil tubing/tubing to release friction around them to move the bottom hole assembly freely downhole and up hole.

Yet another aspect of the current invention is a method of delivering an erratic helical pulsating jet stream within an extended reach tool connected to a drill string pipe/coil tubing or a bottom hole assembly, so that the tool receives fluid from the drill string pipe or coil tubing into a hollow interior of the tool, wherein the fluid is separated into two or more separate flow paths, causing the fluid to be repeatedly compressed and expanded which in turn will create a pulsating flow with erratic helical flow, and causing the pulsating flow to pass out of the tool through ports in the tool to create pulsing and erratic helical jets of fluid. The erratic helically pulsating jets of fluid will cause the extended reach tool to vibrate and pulsate a bottom hole assembly and coil tubing/tubing to release friction around them to move the bottom hole assembly freely downhole and up hole.

Referring back to FIG. 1, the extended reach tool 10 is provided internally with two or more separate flow paths that are repeatedly compressed and expanded to cause the fluid to pulsate in an erratic helical flow pattern, and a single port extending through the extended reach tool 10 that is deflected back to one flow path on a lower end of the tool for delivering erratic helical pulsating jets of fluid out of the tool. The erratic helically pulsating jets of fluid will cause the tool to vibrate and pulsate the bottom hole assembly and coil tubing/tubing.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. An extended reach tool configured to be coupled to (a) a bottom hole assembly that includes a threaded pin and (b) with one of a tubing or a motor, the one of the tubing and the motor including a threaded box, the extended reach tool comprising:

a top side with a threaded box configured to receive the threaded pin of the bottom hole assembly;

a bottom end with a threaded pin, the bottom end being spaced apart from the top side, wherein the threaded pin is configured to be received in the threaded box of the one of the tubing or the motor;

two or more separate flow paths, wherein each of the flow paths has multiple hollow chambers connected in series; each of the hollow chambers comprises a first constricted chamber with a fluid entry, a first expansion chamber located adjacent to a lower end of the first constricted chamber, a second constricted chamber with an upper end of the second constricted chamber connected to a lower end of the first expansion chamber;

a separate second expansion chamber connected to a lower end of each of the second constricted chambers; and a single port located adjacent to a lower end of the second expansion chamber.

2. A method of delivering a pulsing fluid, comprising:

positioning the extended reach tool of claim 1 in a well bore;

providing a fluid to the extended reach tool;

separating the fluid into the two or more separate flow paths in the extended reach tool.

3. A drill string comprising:

at least one of a tubing and a motor;

a bottom hole assembly; and, the extended reach tool of claim 1.

* * * * *